United States Patent [19]

Olovsson

[11] Patent Number: 4,545,463

[45] Date of Patent: Oct. 8, 1985

[54] VERTICALLY ADJUSTABLE PICKING BOX

[76] Inventor: Gunnar Olovsson, 7, Matojärvigatan, S-981 00 Kiruna, Sweden

[21] Appl. No.: 501,207

[22] PCT Filed: Oct. 5, 1982

[86] PCT No.: PCT/SE82/00316

§ 371 Date: Jun. 6, 1983

§ 102(e) Date: Jun. 6, 1983

[87] PCT Pub. No.: WO83/01221

PCT Pub. Date: Apr. 14, 1983

[30] Foreign Application Priority Data

Oct. 6, 1981 [SE] Sweden ..... 8105890

[51] Int. Cl.[4] ..... B66B 9/20

[52] U.S. Cl. ..... 187/9 R; 312/250; 108/27

[58] Field of Search ..... 187/9 R, 17; 211/51; 312/71, 312, 250, 205; 108/27, 147; 414/117, 118, 900, 422, 98

[56] References Cited

U.S. PATENT DOCUMENTS 764,527 7/1904 Ingalls ..... 312/71
1,330,927 2/1920 Watkins ..... 187/9 R
3,018,149 1/1962 Parker ..... 312/71
3,413,050 11/1968 Sommers et al. ..... 312/205
3,663,078 5/1972 Moore et al. ..... 312/71
4,357,127 11/1982 Kooiman ..... 312/71
4,369,887 1/1983 Emery ..... 211/51

FOREIGN PATENT DOCUMENTS 956232 1/1957 Fed. Rep. of Germany ..... 414/118

*Primary Examiner*—H. Grant Skaggs
*Assistant Examiner*—Kenneth Noland
*Attorney, Agent, or Firm*—Sherman & Shalloway

[57] ABSTRACT

A liftable and lowerable picking box (1) for storing workpieces at a workplace comprises a stand (2), which guides a liftable and lowerable box (8) consisting of a bottom (9) and three sidewalls (10–12). A fourth sidewall (13) facing to the operator can be connected detachably to the stand (2) at a level suitable for the operator. As the height of the box (8) filled with workpieces can be adjusted successively by means of a lifting and lowering device (7), details can be picked all the time from a comfortable height without obstruction by the sidewall (13) attached to the stand.

6 Claims, 1 Drawing Figure

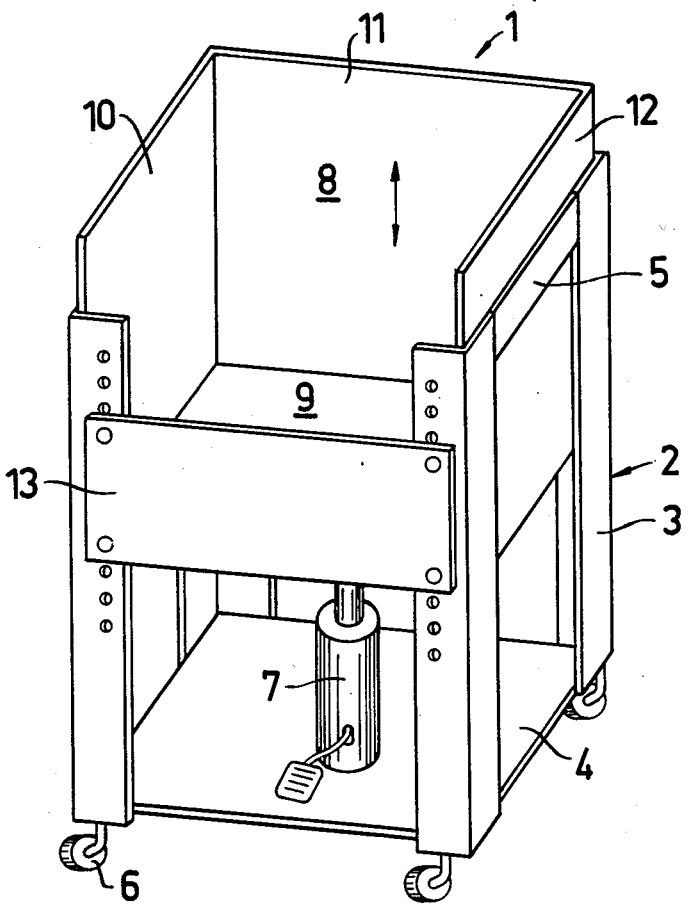
11
1
10
12
8
5
9
2
13
3
7
4
6

VERTICALLY ADJUSTABLE PICKING BOX

This invention relates to a picking box, which can be lifted and lowered, for storing workpieces at a workplace, which picking box comprises a stand, which may be wheeled, with a vertically operating lifting and lowering device for an upwardly open box consisting of a bottom and sidewalls about the same and guided by the stand or by the lifting and lowering device.

At mass manufacture of small details it is normal use to store semi-finished products in a box, which is placed at the machine where the next working step is to be carried out. The machine operator picks details out of the box, positions them in the working machine, removes them therefrom after completed working and places them in a second box for being conveyed to the next operation. The picking of details out of the box becomes increasingly more difficult with increasing depth of position of the details in the box, i.e. as the box is being emptied of details. As the operator's place in most cases is directly in front of the machine, owing a.o. to the location of the control means, and the box stands to the side of the machine, the operator is forced to carry out movements, which from an ergonomic aspect are unsuitable, because the operator must turn the back and simultaneously bend down for picking up details from the box, in which the details gradually are located at an increasingly lower level.

It has been tried to solve this problem in different ways, for example by positioning the box on a vertically adjustable table, in order thereby to obtain a more suitable working height and thereby to reduce the back bending. It also is possible to incline the box, so that its bottom slopes toward the operator whereby the access to the details located farthest away from the operator is improved. All conventional solutions, however, have the disadvantage that the box sidewall located closest to the operator obstructs the picking.

The present invention has the object to provide a device, by means of which the said disadvantages are eliminated. This object is achieved in that the device has been given the characterizing features defined in the attached claims.

The advantages of the invention over conventional solutions are, that the invention offers a picking box, the sidewall of which facing to the operator does not obstruct the picking of details from the box, and that the picking box in addition can be lifted and lowered for successive adjustment to the most suitable picking height.

BRIEF DESCRIPTION OF THE DRAWINGS

Embodiments of the invention are described in the following, with reference to the accompanying drawing, which is a perspective view of a vertically adjustable picking box according to the invention.

SPECIFIC DESCRIPTION OF THE PREFERRED EMBODIMENTS

The liftable and lowerable picking box designated in its entirety by 1 comprises a stand 2, which is assembled of four angle sections 3, which at their lower ends are connected to a bottom plate 4 and at their upper ends are connected to three flat bars 5. The stand 2 can be provided with rollers or wheels 6 attached beneath the corners of the bottom plate 4 and intended to facilitate the movement of the entire arrangement. Above the bottom plate 4 and centrally thereon a device 7 is provided for lifting and lowering a box 8 located inside of the angle sections 3 of the stand. The lifting and lowering movement can be effected in many different ways within the scope of the present invention. The embodiment shows a hydraulic means with foot pump. Other imaginable machine elements for effecting the lifting and lowering movement of the box are, for example, linear screws, gear racks or compressed air cylinders. The drive of the movement may be both manual and mechanical.

The box 8, which is guided by the angle sections 3, comprises a bottom 9 and three sidewalls 10,11,12, which are rigidly connected to the bottom 9. A fourth box sidewall 13 is detachably connected to two of the angle sections 3 of the stand, for example by screws or some type of quick-acting lock. The fourth sidewall 13 can be attached to the angle sections 3 on different levels.

Prior to the filling of the liftable and lowerable picking box with details to be worked, the height of the box 8 is adjusted so that the upper edge of the sidewalls 10,11,12 is located on substantially the same level as the upper edge of the sidewall 13, which had been mounted previously at a height suitable for the workpiece in question. The box 8 can thereafter be lifted by the lifting and lowering device 7 at the same pace as the details in the picking box are being consumed, so that all the time a suitable working height is maintained.

It may be suitable in certain cases to put down worked details into a liftable and lowerable picking box according to the invention. This is particularly suitable when there is risk for the details to be damaged by being dropped into a box of great depth. By utilizing the vertical adjustability of the picking box the details can be placed carefully in the box with a minimum movement of the body required. Another reason for placing the worked details in a picking box according to the invention may be, that the subsequent operation is facilitated by using the box, in which case the liftable and lowerable picking box only must be moved to the next workplace.

When the box 8 is prepared for attaching an insert wall in the same inside of the wall 13, and when the box, besides, is adapted for lifting, it can be moved easily to another stand, whereafter the insert wall is removed.

The bottom 9 of the box can be designed so as to be inclined to the sidewall 13 attached to the stand, resulting in that the details in the box slide to the sidewall 13 and thereby will be easily accessible for the operator.

The guide for the box 8 can be arranged in several different ways. The stand, for example, can be constructed of pipes, and the box be provided with sleeves guiding on the pipes. The lifting and lowering device can be designed so as also serving for guiding the box.

The box 8 may within the scope of the invention have a configuration other than square or rectangular.

Also an alternative embodiment can be imagined, at which the box bottom 9 is liftable and lowerable, and the sidewalls 10,11,12 are rigidly connected to the stand 2 instead of to the bottom 9. This embodiment, however, has the disadvantage a.o. that the details in the box slide and wear all sidewalls of the box when the bottom is being lifted.

I claim:

1. A liftable and lowerable box (1) for storing workpieces at a workplace, which box comprises a stand (2), which may be wheeled, with a vertically operating lifting and lowering device (7) for an upwardly open container (8), which container consists of a bottom (9) and sidewalls about the bottom and is guided by the stand or by the lifting and lowering device, characterized in that at least one sidewall is connected to the bottom of the container and that another sidewall is removably and non-pivotally connected to the stand at one of a plurality of pre-determined levels.

2. A liftable and lowerable box as defined in claim 1, wherein said sidewalls are four in number (10–13), characterized in that three of the sidewalls (10, 11, 12) are rigidly connected to the bottom (9) of the container while the fourth sidewall (13) of the container comprises said another sidewall.

3. A liftable and lowerable box as defined in claim 2, characterized in that the bottom (9) of the container is inclined to the fourth sidewall (13).

4. A liftable and lowerable box as defined in any one of the claims 1 or 2, characterized in that the stand with vertical corner portions (3) forms the guide of the container (8).

5. A liftable and lowerable box as defined in any one of the claims 1 or 2, characterized in that the lifting and lowering device (7) forms the guide of the box container (8).

6. A liftable and lowerable box as defined in any one of the claims 1 or 2, characterized in that the lifting and lowering device (7) is a hydraulic cylinder with foot pump.

* * * * *